US011078920B2

(12) United States Patent
Henner et al.

(10) Patent No.: US 11,078,920 B2
(45) Date of Patent: Aug. 3, 2021

(54) PROPELLER FOR FAN OF A THERMAL SYSTEM OF A MOTOR VEHICLE, FAN AND THERMAL SYSTEM COMPRISING SUCH A PROPELLER

(71) Applicant: Valeo Systemes Thermiques, Le Mesnil Saint Denis (FR)

(72) Inventors: Manuel Henner, Le Mesnil Saint Denis (FR); Bruno Demory, Le Mesnil Saint Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 33 days.

(21) Appl. No.: 16/623,537

(22) PCT Filed: Jun. 29, 2018

(86) PCT No.: PCT/EP2018/067663

§ 371 (c)(1),
(2) Date: Dec. 17, 2019

(87) PCT Pub. No.: WO2019/002585

PCT Pub. Date: Jan. 3, 2019

(65) Prior Publication Data

US 2020/0141420 A1 May 7, 2020

(30) Foreign Application Priority Data

Jun. 30, 2017 (FR) ..... 1756203

(51) Int. Cl.
*F04D 29/32* (2006.01)
*F04D 19/00* (2006.01)
*F04D 25/06* (2006.01)

(52) U.S. Cl.
CPC ..... *F04D 29/329* (2013.01); *F04D 19/002* (2013.01); *F04D 25/06* (2013.01)

(58) Field of Classification Search
CPC ..... F04D 19/002; F04D 25/06; F04D 25/08; F04D 29/329; F04D 39/34
See application file for complete search history.

(56) References Cited

U.S. PATENT DOCUMENTS 2,801,793 A * 8/1957 Kline ..... F04D 29/329 416/93 R
3,303,995 A * 2/1967 Boeckel ..... F24F 7/007 417/353

(Continued)

FOREIGN PATENT DOCUMENTS

DE 202010013785 U1 2/2011
WO 99/07999 A1 2/1999
WO 2014/087009 A1 6/2014

OTHER PUBLICATIONS

International Search Report and Written Opinion corresponding to International Application No. PCT/EP2018/067663, dated Sep. 18, 2018, (13 pages).

*Primary Examiner* — Patrick Hamo
(74) *Attorney, Agent, or Firm* — Osha Bergman Watanabe & Burton LLP

(57) ABSTRACT

The propeller (16) for a fan (14) of a motor vehicle thermal system (10) comprises a bowl (22) for receiving a motor (18) of the propeller (16) and at least one blade (34) connected to the receiving bowl (22), the receiving bowl (22) further comprising:

a central member (26) comprising at least one through-orifice (30), a collar (28) extending around the central member (26), the blade (34) extending radially outwards from the collar (28), and at least one rib (36) arranged on a front face of the collar (28), with reference to a direction of flow of an air flow (F) generated by the propeller (16), extending radially (Continued)

outwards so as to have a curved shape oriented in the opposite direction to a direction of rotation of the propeller (16).

10 Claims, 2 Drawing Sheets

(56) References Cited

U.S. PATENT DOCUMENTS

| | | | | |
|---|---|---|---|---|
| 5,582,507 | A * | 12/1996 | Alizadeh | F04D 19/002 248/604 |
| 2004/0076515 | A1 | 4/2004 | Hsieh | |
| 2004/0076516 | A1* | 4/2004 | Bird | F04D 29/30 415/206 |
| 2010/0178181 | A1 | 7/2010 | Chen et al. | |
| 2018/0003190 | A1* | 1/2018 | Hamada | F04D 29/38 |
| 2021/0003140 | A1* | 1/2021 | Yamamoto | F04D 17/025 |

* cited by examiner

PROPELLER FOR FAN OF A THERMAL SYSTEM OF A MOTOR VEHICLE, FAN AND THERMAL SYSTEM COMPRISING SUCH A PROPELLER

FIELD OF THE INVENTION

The invention relates to vehicles and in particular motor vehicles. The invention also relates to the thermal systems of the vehicles. More specifically, the invention relates to the propellers of the fans of these thermal systems.

TECHNOLOGICAL BACKGROUND OF THE INVENTION

A motor vehicle generally comprises at least one thermal system. For example, the motor vehicle comprises a thermal system intended to provide thermal control, cooling or heating, of a passenger compartment of the motor vehicle. It can for example be an air conditioning system of the vehicle. The motor vehicle also comprises a thermal system intended to cool an engine, generally an internal combustion engine, of the vehicle.

Motor vehicle thermal systems often comprise at least one fan. The fan is usually intended to direct an air flow through a heat exchanger that can in particular be a shell and tube heat exchanger.

The fan thus comprises a propeller the mechanical work required for the rotation of which is supplied by a motor that is generally electric. The propeller comprises a receiving bowl from which extends a plurality of blades. Moreover, the motor of the propeller is fixed to the receiving bowl.

During operation, the motor heats up, which risks damaging it. As a result, the receiving bowl of the propeller can have two different architectures in order to cool the motor.

According to a first architecture, the receiving bowl comprises at least one through-orifice facing a through-orifice of the motor. Such receiving bowls are sometimes referred to as "open bowls". Thus, part of the air flow generated by the propeller passes through the motor and the receiving bowl due to a pressure difference between the upstream and downstream sides of the propeller. Thus, the motor is cooled relatively effectively. However, this part of the air flow that has passed through the motor and the receiving bowl, from the downstream to the upstream side of the propeller, disrupts the air flow going from the upstream to the downstream side of the propeller. This disruption has the effect of reducing the efficiency of the propeller.

According to a second architecture, the receiving bowl does not comprise a through-orifice, while the motor does. However, the receiving bowl comprises a pipe that leads to the roots of the blades downstream of the propeller. Such receiving bowls are described as "closed bowls". Thus, part of the air flow generated by the propeller passes through the motor and the pipe. The part of the air flow used to cool the motor is therefore confined in the downstream part of the propeller, which has the effect of not altering the efficiency of the propeller. However, the cooling is less effective than with an open receiving bowl as the part of the air flow used to cool the motor does not have the same flow rate as with an open bowl.

OBJECT OF THE INVENTION

One aim of the invention is to supply a propeller for a fan of a thermal system that retains satisfactory efficiency and the motor of which can be cooled effectively.

BRIEF DESCRIPTION OF THE INVENTION

To do this, the invention envisages a propeller for a motor vehicle thermal system fan, characterized in that it comprises a bowl for receiving a motor of the propeller and at least one blade connected to the receiving bowl, the receiving bowl further comprising:

- a central member comprising at least one through-orifice,
- a collar extending around the central member, the blade extending radially outwards from the collar, and
- at least one rib arranged on a front face of the collar, with reference to a direction of flow of an air flow generated by the propeller, extending radially outwards so as to have a curved shape oriented in the opposite direction to a direction of rotation of the propeller.

Thus, the central member of the receiving bowl comprises a through-orifice that is intended to be arranged facing a through-orifice of the motor in order to generate an air flow intended to cool the motor. This air flow has a sufficient flow rate to cool the motor effectively, as it is linked to a pressure difference between the upstream and downstream sides of the propeller.

In addition, when this air flow leaves the through-orifice of the central member, it comes out on a front face of the central member, upstream of the propeller. The faces of the central member and the collar facing the upstream side of the propeller are referred to as the "front face" of the central member or the collar. Thus, opposite faces of the central member and the collar are referred to as the "rear face". The air flow therefore reaches the front face of the collar. The rib arranged on the front face of the collar is oriented in the opposite direction to the direction of rotation of the propeller. As a result, the rib compensates for a gyration transferred to the air flow due to the rotation of the propeller. Thus, when the air flow leaves the collar to arrive at the root of the blade, it only slightly disturbs an air flow going from the upstream to the downstream side of the propeller. Consequently, the efficiency of the propeller is only slightly affected by this air flow.

The propeller according to the invention therefore makes it possible to cool the motor effectively while retaining satisfactory efficiency.

Moreover, in various embodiments of the invention, one or more of the following arrangements may also be used:

- an angle formed by a straight line tangent to the rib and passing through an outer radial end of the rib, and a straight line passing through a center of the collar and the outer radial end of the rib, is between 15° and 100° and preferably between 20° and 80°; the angle can also be between 20° and 70°; generally, the angle is at least equal to 20°; it has been found that such angular values make it possible to retain satisfactory efficiency of the propeller;
- the collar extends at a distance from the central member so as to form a passage between the collar and the central member;
- the propeller comprises at least one second rib arranged on the front face of the collar and extending partially on the passage formed between the collar and the central member, the second rib extending radially outwards to as to have a curved shape oriented in the opposite direction to the direction of rotation of the propeller; this second rib also makes it possible to compensate for the gyration transferred to the air flow and to structurally reinforce the receiving bowl of the propeller;
- the central member is offset relative to the collar, in a direction orthogonal to the collar;

the central member is disk-shaped;

the through-orifice of the central member is formed in the center of the central member; and the central member, the collar and the blade are integrally formed.

The invention also envisages a fan for a motor vehicle thermal system comprising a propeller as described previously, and an electric motor comprising a through-orifice arranged facing the through-orifice of the central member of the propeller.

Finally, a thermal system for a motor vehicle is envisaged, comprising a fan as described above.

BRIEF DESCRIPTION OF THE DRAWINGS

An embodiment of the invention will now be described by way of non-limitative example, with reference to the following figures.

DETAILED DESCRIPTION OF AN EMBODIMENT OF THE INVENTION

Figure 1:
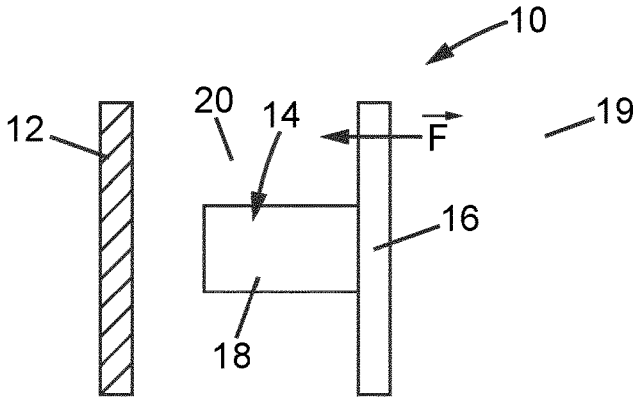
FIG. 1 is a diagrammatic illustration of one portion of a thermal system according to the invention.

FIG. 1 is a diagrammatic representation of a portion of a thermal system 10 according to the invention. The thermal system 10 is arranged in a motor vehicle. Its function is to cool an internal combustion engine that produces mechanical work to move the motor vehicle. It will be noted that according to the invention, the thermal system 10 of the motor vehicle can have any type of function and can for example be intended to provide thermal control of a passenger compartment of the motor vehicle. Similarly, the thermal system 10 can be arranged in any type of vehicle.

The thermal system 10 comprises a plate heat exchanger 12. This plate heat exchanger 12 is connected to other parts of the thermal system 10. The thermal system 10 further includes a fan 14. The fan 14 has the function of directing an air flow F, diagrammatically represented by means of an arrow in FIG. 1, to the plate exchanger 12.

The fan 14 comprises a propeller 16 and an electric motor 18. The electric motor 18 delivers mechanical work so as to enable the propeller 16 to produce the air flow F. As illustrated in FIG. 1, the propeller 16 demarcates an upstream space 19 and a downstream space 20. When the fan 14 is operating, the pressure is higher in the downstream space 20 than in the upstream space 19.

Figure 2:
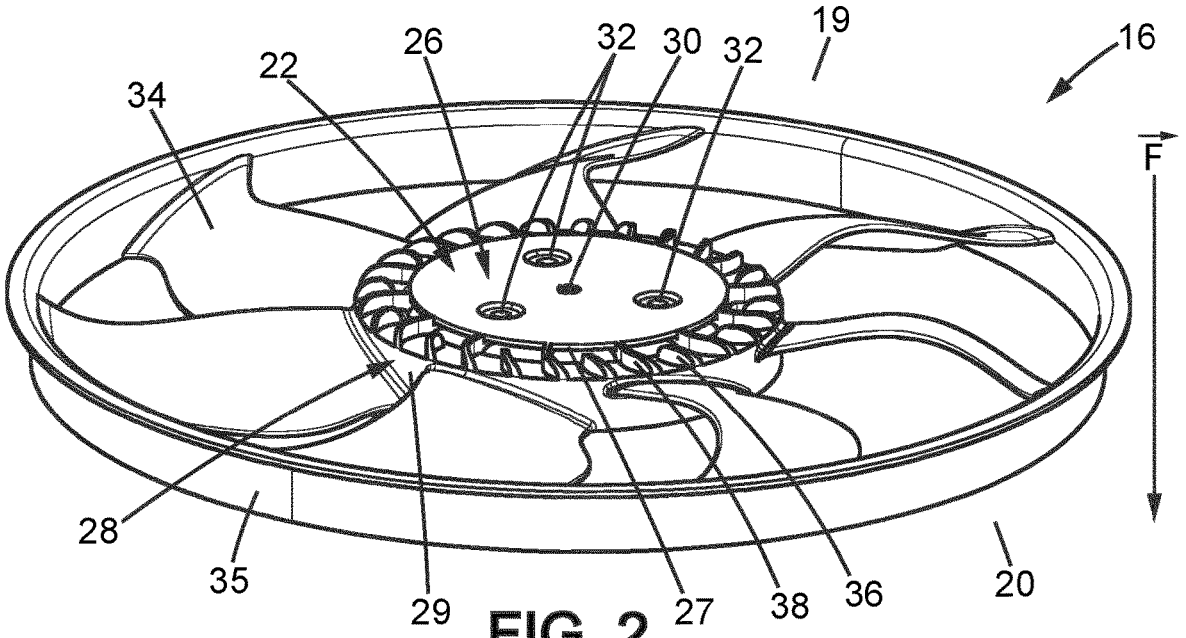
FIG. 2 is a perspective view of a propeller of the thermal system.
Figure 3:
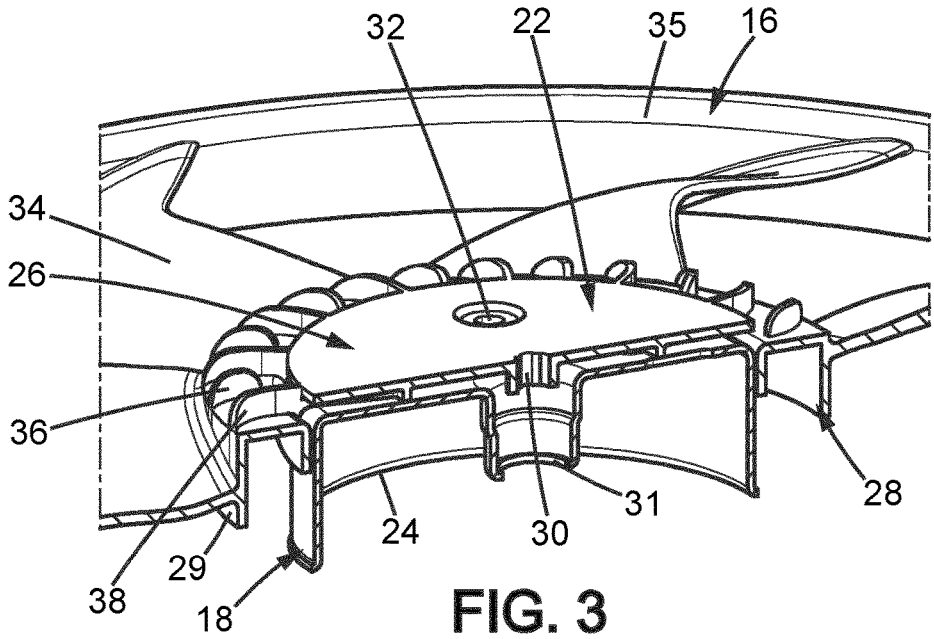
FIG. 3 is a cross-sectional perspective view of the propeller and a motor of the propeller.
Figure 4:
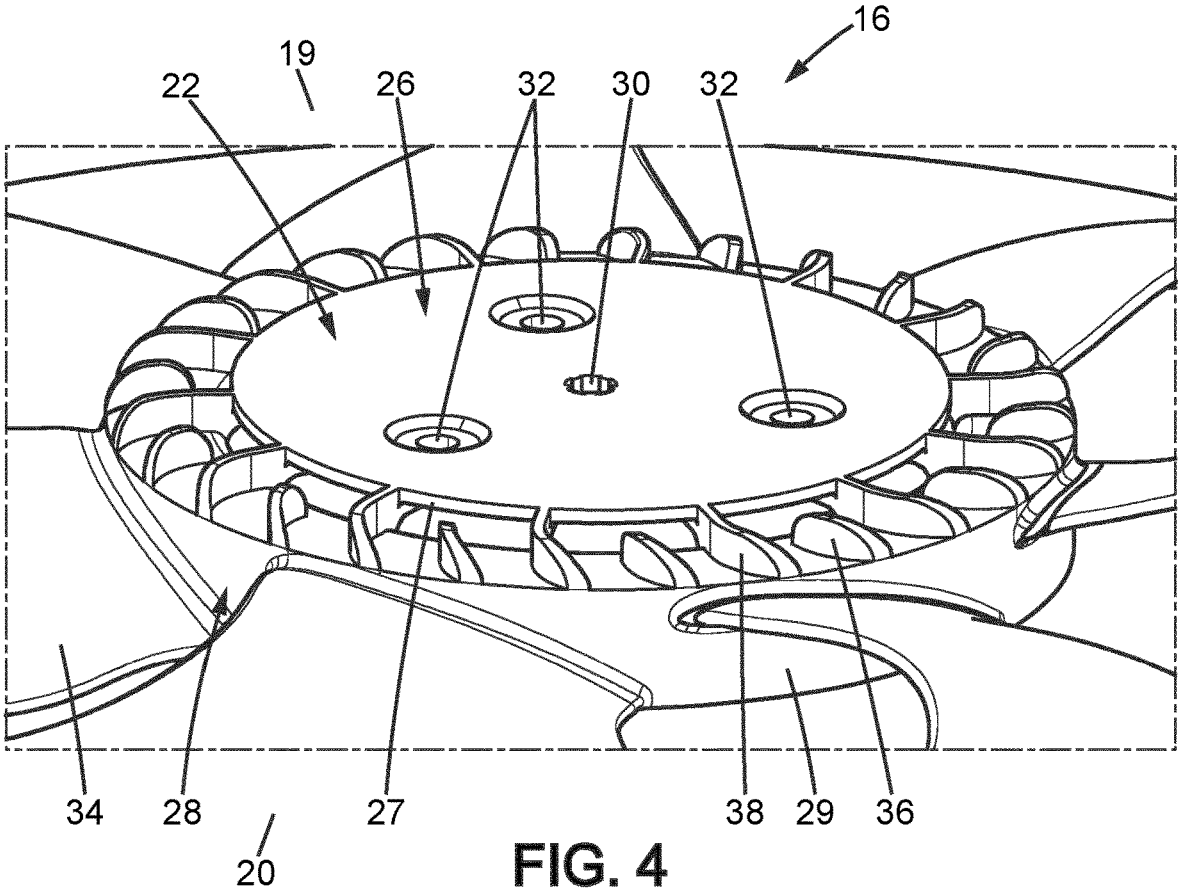
FIG. 4 is a perspective view of the propeller similar to the view in FIG. 2 but showing a close-up of a central member of the propeller.

The propeller 16 will now be described in more detail with reference to FIGS. 2 to 4. These figures show a face of the propeller 16 referred to as the "front" face. This face is facing the upstream space 19. An opposite face of the propeller, referred to as the "rear" face, is facing the downstream space 20. Thus, the front and rear faces are defined with reference to the direction of flow of the air flow F generated by the propeller 16 when it is in operation.

The propeller 16 comprises a receiving bowl 22. The receiving bowl 22 makes it possible to fix the electric motor 18 to the propeller 16 as illustrated in FIG. 3. As this figure shows, the electric motor 18 includes an elongate body 24 a longitudinal end of which is fixed to a rear face of the receiving bowl 22.

The receiving bowl 22 comprises a central member 26 and a collar 28. The central member 26 has a planar disk shape and comprises a through-orifice 30 made in its center. The electric motor 18 also comprises a through-orifice 31 extending along a longitudinal direction of the electric motor 18. Thus, as can be observed in FIG. 3, the through-orifice 31 of the electric motor 18 is facing the through-orifice 30 of the central member 26 of the receiving bowl 22. In addition, these two through-orifices 30, 31 are arranged one after the other so as to form an air circuit as will be described in greater detail below.

In addition, the central member 26 includes three orifices 32 the function of which is to accommodate means for fixing the central member 26 to the electric motor 18. The collar 28 is also planar and extends around and at a distance from the central member 26 so as to form a passage between the collar 28 and the central member 26. The central member 26 is offset towards the front relative to the collar 28, in a direction parallel to the air flow F, which is also a direction orthogonal to the collar 28.

The propeller 16 also comprises a plurality of blades 34. Each blade 34 extends radially outwards from an outer peripheral contour 29 of the collar 28. The propeller 16 also comprises an outer collar 35 that connects the plurality of blades 34 at their outer radial ends.

The collar 28 further comprises a first series of ribs 36. These ribs 36 are arranged on the front face of the collar 28. The ribs 36 extend on the front face of the collar 28 only. These ribs 36 are all the same shape. They extend radially outwards so as to have a curved shape oriented in the opposite direction to a direction of rotation of the plurality of blades 34 of the propeller 16.

The collar 28 also includes a second series of ribs 38. These ribs 38 each comprise an inner radial end that is fixed to a peripheral contour 27 of the central member 26 as can be seen in particular in FIGS. 3 and 4. The ribs 38 further extend partially on the front face of collar 28. Thus, the ribs 38 extend partially on the passage formed between the central member 26 and the collar 28. The ribs 38 further have a curved shape identical to that of the ribs 36. They therefore also extend radially outwards so as to have a curved shape oriented in the opposite direction to a direction of rotation of the plurality of blades 34 of the propeller 16. In addition, the ribs 38 further have a function of structurally reinforcing the receiving bowl 22. They also have a function of connecting the central member 26 and the collar 28.

In this embodiment, the first series of ribs 36 and the second series of ribs 38 have an identical curvature. Thus, an angle formed by a straight line tangent to one of the ribs 36, 38 and passing through the outer radial end thereof, and a straight line passing through a center of the collar 28 and this outer radial end, is at least equal to 15° or 20°. Preferably, this angle is between 20° and 70°, or between 20° and 80°. This angle can also more generally be between 15° and 100°. Similarly, in this embodiment, the first series of ribs 36 and the second series of ribs 38 have identical thicknesses.

It will also be noted that according to a variant of the present embodiment, the first series of ribs 36 and the second series of ribs 38 can have different curvatures. Moreover, two ribs 36 can have different curvatures from each other. Similarly, two ribs 38 can also have different curvatures from each other. Furthermore, the ribs 36 and 38 can have thicknesses that are not identical. In the same way, two ribs 36 or two ribs 38 can have different thicknesses or lengths from each other.

In this embodiment, the propeller 16 is formed by injection. Thus, the central member 26, the collar 28, the plurality of blades 34 and the outer collar 35 are integrally formed. The propeller is then formed in a single part, forming a one-piece part, that can be obtained in particular by injecting plastic material into a mold. According to variants, at least one of the central member 26, the collar 28, the plurality of blades 34 and the outer collar 35 can be formed separately and then assembled with the other parts of the propeller 16.

The cooling of the electric motor 18 when the fan 14 is actuated will now be described.

As stated previously, when the fan 14 is actuated, an air flow F is generated by the plurality of blades 34 from the upstream space 19 to the downstream space 20. This air flow F therefore causes the occurrence of higher pressure in the downstream space 20 than in the upstream space 19.

As a result, a second air flow, the flow rate of which is significantly lower than the air flow F, passes through the through-orifice 31 of the electric motor 18 and then the through-orifice 30 in the central member 26. It therefore cools the electric motor 18. Moreover, it therefore reaches the front face of the central member 26 from where it is directed radially outwards. It therefore encounters the ribs 38 and then the ribs 36. As they are oriented in the opposite direction to the direction of rotation of the plurality of blades 34, these ribs 36, 38 compensate for the gyration imparted by the rotation of the propeller 16 to the second air flow. Consequently, when this second air flow reaches the roots of the plurality of blades 34, it only slightly disrupts the air flow F. The efficiency of the propeller 16 is thus only slightly affected.

Of course, numerous modifications can be made to the invention without departing from the scope thereof.

The central member 26 can have a square shape or any other shape.

The invention claimed is:

1. A propeller for a fan of a motor vehicle thermal system, the propeller comprising:
- a bowl for receiving a motor of the propeller, and
- at least one blade connected to the bowl,
- the bowl further comprising:
  - a central member comprising at least one through-orifice,
  - a collar extending around the central member, the at least one blade extending radially outwards from the collar, and
  - at least one rib arranged on a front face of the collar, with reference to a direction of flow of an air flow generated by the propeller, extending radially outwards so as to have a curved shape oriented in the opposite direction to a direction of rotation of the propeller.

2. The propeller as claimed in claim 1, in which an angle formed by a straight line tangent to one of the at least one ribs and passing through an outer radial end of the one of the least one ribs, and a straight line passing through a center of the collar and the outer radial end of the one of the at least one ribs, is between 20° and 80°.

3. The propeller as claimed in claim 1, in which the collar extends at a distance from the central member so as to form a passage between the collar and the central member.

4. The propeller as claimed in claim 3, further comprising:
- at least one second rib arranged on the front face of the collar and extending partially on the passage formed between the collar and the central member,
- at least one the second rib extending radially outwards so as to have a curved shape oriented in the opposite direction to the direction of rotation of the propeller.

5. The propeller as claimed in claim 4, wherein the central member is offset relative to the collar, in a direction orthogonal to the collar.

6. The propeller as claimed in claim 1, wherein the central member is disk-shaped.

7. The propeller as claimed in claim 6, wherein the at least one through-orifice of the central member is formed in the center of the central member.

8. The propeller as claimed in claim 1, wherein the central member, the collar and the at least one blade are integrally formed.

9. A fan for a motor vehicle thermal system comprising:
- a propeller comprising:
  - a bowl for receiving a motor of the propeller, and
  - at least one blade connected to the bowl, the bowl further comprising:
    - a central member comprising at least one through-orifice,
    - a collar extending around the central member, the at least one blade extending radially outwards from the collar, and
  - at least one rib arranged on a front face of the collar, with reference to a direction of flow of an air flow generated by the propeller, extending radially outwards so as to have a curved shape oriented in the opposite direction to a direction of rotation of the propeller; and
- an electric motor comprising a through-orifice arranged facing the at least one through-orifice of the central member of the propeller.

10. A thermal system for a motor vehicle comprising:
- a fan comprising a propeller, and an electric motor comprising a through-orifice arranged facing a corresponding through-orifice of the central member of the propeller,
- the propeller comprising:
  - a bowl for receiving a motor of the propeller; and
  - at least one blade connected to the bowl, the bowl further comprising:
    - a central member comprising at least one through-orifice,
    - a collar extending around the central member, the blade extending radially outwards from the collar, and
    - at least one rib arranged on a front face of the collar, with reference to a direction of flow of an air flow generated by the propeller, extending radially outwards so as to have a curved shape oriented in the opposite direction to a direction of rotation of the propeller.

* * * * *